US005931241A

United States Patent [19]

Daly

[11] Patent Number: 5,931,241

[45] Date of Patent: Aug. 3, 1999

[54] HYDROSTATIC THRUST FACE LUBRICATION SYSTEM

[75] Inventor: Jeffery E. Daly, Cypress, Tex.

[73] Assignee: Camco International Inc., Houston, Tex.

[21] Appl. No.: 08/781,217

[22] Filed: Jan. 10, 1997

Related U.S. Application Data

[63] Continuation of application No. 08/520,431, Aug. 29, 1995, Pat. No. 5,628,375.

[51] Int. Cl.[6] ..... E21B 10/22

[52] U.S. Cl. ..... 175/227; 175/371; 384/93

[58] Field of Search ..... 175/227, 228, 175/229, 371, 372; 384/93

[56] References Cited

U.S. PATENT DOCUMENTS

| | | | |
|---|---|---|---|
| 1,896,231 | 2/1933 | Fletcher | 175/228 |
| 1,909,128 | 5/1933 | Scott et al. | 175/228 |
| 2,906,504 | 9/1959 | Parks | 255/305 |
| 3,048,230 | 8/1962 | Angel | 175/228 |
| 3,137,508 | 6/1964 | Cunningham | 277/95 |
| 3,244,459 | 4/1966 | Ortloff | 309/8.2 |
| 3,251,634 | 5/1966 | Dareing | 175/228 X |
| 3,307,645 | 3/1967 | Hildebrandt | 175/372 |
| 3,365,247 | 1/1968 | Ferrand | 175/372 |
| 3,841,422 | 10/1974 | Crow | 175/229 |
| 3,844,364 | 10/1974 | Crow | 175/228 |
| 3,866,695 | 2/1975 | Jackson | 175/228 |
| 4,167,219 | 9/1979 | McQueen | 175/229 |
| 4,181,185 | 1/1980 | Keller et al. | 175/229 |
| 4,183,416 | 1/1980 | Walters | 175/229 |
| 4,240,674 | 12/1980 | Evans | 308/8.2 |
| 4,390,072 | 6/1983 | Phelan | 175/229 |
| 4,412,590 | 11/1983 | Daly | 175/229 |
| 4,446,933 | 5/1984 | Bodine | 175/229 |
| 4,452,323 | 6/1984 | Daly | 175/229 |
| 4,501,338 | 2/1985 | Underwood | 175/229 |
| 5,099,932 | 3/1992 | Hixon | 175/229 |
| 5,188,462 | 2/1993 | Hooper et al. | 384/93 |
| 5,265,964 | 11/1993 | Hooper | 384/93 |

FOREIGN PATENT DOCUMENTS

| | | | |
|---|---|---|---|
| 926222 | 5/1982 | Russian Federation | 175/371 |
| 976010 | 11/1982 | Russian Federation | 175/371 |
| 1640337 | 4/1991 | Russian Federation | 175/229 |

*Primary Examiner*—Hoang C. Dang

[57] ABSTRACT

A rolling cutter drill bit comprises a main body and three depending legs, each leg having a cantilevered bearing spindle on which a rolling cutter is rotatably mounted. Bearings located between the cutter and spindle include a radial bearing, and a thrust bearing configured to carry onward thrust loads from the cutter onto the spindle. A bearing seal defines an enclosed region between the cutter and the spindle in which the bearings are located, and a pressure balanced lubricant delivery system within the spindle delivers lubricant to the bearings. The lubricant delivery system includes a non-return valve to allow lubricant to flow into the area of the enclosed region containing the thrust bearing and the area is bounded by a tortuous flow path which allows a more restricted flow of lubricant out of the thrust bearing area and into another area of the enclosed region, without pressurizing the bearing seal. The non-return valve may be replaced by a flexible barrier ring in the tortuous path which deflects to allow a greater flow of lubricant into the thrust bearing area.

7 Claims, 4 Drawing Sheets

HYDROSTATIC THRUST FACE LUBRICATION SYSTEM

This is a Continuation Application of U.S. patent application Ser. No. 08/520,431, filed Aug. 29, 1995, now the U.S. Pat. No. 5,628,375.

BACKGROUND OF THE INVENTION

1. Field of the Invention

The present invention relates to the art of earth boring with rolling cutter drill bits. In particular, this invention relates to an improved thrust bearing for sealed and lubricated three cone earth boring bits utilized for gas and oil well drilling.

2. Description of Related Art

Sealed and lubricated rolling cutter drill bits (also called rock bits) typically have three different bearing structures in each cutter. The first bearing structure is designed to handle cantilevered radial loads and is typically a journal bearing or a roller bearing.

The second bearing structure is designed to retain the rolling cutter upon the cantilevered bearing spindle when the cutter is subjected to offward thrust. This retention system is generally comprised of either ball bearings or a friction bearing such as a snap ring or a threaded retaining ring. The third bearing structure is designed to carry onward axial thrust loads and is most often a friction type bearing. This thrust bearing in rolling cutter drill bits is the object of the present invention.

Analysis of used rolling cutter drilling bits shows that when high loads are combined with high rpm, the thrust bearing often fails or the resulting heat build up causes degradation of the other bearings. Even though a great many designs and materials for rock bit thrust bearing have been used in an attempt to solve this problem, thrust bearing performance still remains a source of bearing failure, especially at very high rpm.

A number of bearing material and lubrication schemes have been used in the past by drill bit designers to improve thrust face performance. Lubricant circulating systems, as shown in U.S. Pat. Nos. 3,841,422; 3,844,364; 4,167,219; 4,181,185; 4,183,416; 4,240,674; 4,390,072; 4,412,590; 4,446,933; 4,452,323; 4,501,338; and 5,099,932 promote the flow of fresh lubricant through the bearings with minimal pressurization.

Means of pressuring lubricant in a rock bit to prolong bearing life are shown in U.S. Pat. Nos. 2,906,504; 3,244,459; and 3,866,695. In these designs the lubricant in the entire bearing cavity and around the bearing seal is pressurized. This pressurization can severely limit the life of the bearing seal, however, because seal life depends, in part, upon how long the seal is subjected to a given pressure differential.

Typically, a rock bit bearing seal will survive for no more than a few hours with a constant 300 psi pressure differential. If the prior art bearing pressurization systems were applied to modern drill bits, the bearing seals would have to withstand differential pressures in excess of 1000 psi for long periods of time, perhaps more than 100 hours, and could experience peak differential pressures greater than 5000 psi.

Many of the above patented lubrication systems take advantage of the reciprocating piston action of the rolling cutter upon the bearing spindle of a drill bit to provide the pumping action. Drill bits typically have 0.010"–0.025" axial play of the cutter upon the bearing spindle. As described in U.S. Pat. No. 3,137,508, lubrication flow as the rolling cutter moves axially along the bearing spindle can cause pressure fluctuations in the lubricant of up to 1800 times per minute during operation. In many of the above lubricant pressurization and circulating patents, this flow has been harnessed to provide power for the lubricant pumping system.

Another scheme to improve thrust bearing performance in rock bits is a hydrodynamic lubrication system at the thrust bearing face, such as shown in U.S. Pat. Nos. 5,188,462 and 5,265,964. Hydrodynamic schemes are intended to increase the lubricant film thickness at the thrust face interface. Although the film thickness can increase slightly in these designs, the thrust bearing still operates in a thin film, boundary layer lubrication regime, and the thrust bearing life does not appear to significantly improve.

Finally, a great number of bearing material, tribological, and lubricant engineering systems are known in the art, and are intended to increase the bearing life and/or reduce the rubbing friction at the thrust face under the typical thin film, boundary layer lubrication present at the thrust faces of typical modem sealed and lubricated rolling cutter drill bits.

The present invention provides a new thrust face bearing/lubrication system which utilizes pressurized lubricant at the thrust face area to provide a thick, hydrostatic lubricant film. This thick, hydrostatic lubricant film helps to prevent asperity contact of the mating thrust bearing surfaces, reducing friction and wear, and thus prolonging bit life. The thick, pressurized film is maintained by capitalizing upon the normal piston effect of the cutter upon the bearing spindle to pump lubricant through a one way valve into the thrust area. The passageways for the lubricant to flow out of the thrust area are deliberately restricted, allowing the lubricant to become pressurized. The restrictions in the lubricant flow out of the thrust area are placed so that only the thrust face area and adjacent bearings are pressurized, leaving the bearing seal in the drill bit to operate conventionally, without unusually high pressure differentials.

As the cutter moves on and off the bearing spindle during operation, the thrust faces will separate by the amount of axial play allowed by the cutter retaining bearing, forming a clearance gap. In a typical rolling cutter drill bit, the clearance gap (and consequentially the lubricant film thickness) will be 0.010" to 0.025". When the cutter experiences an onward axial thrust load, the lubricant becomes pressurized, carrying the load. The lubricant will flow around the restriction and out of the thrust area at a rate related to the onward load. As the lubricant flows out, the clearance gap is reduced.

After a time, the onward load will reverse, the cutter will again be pushed off the bearing spindle, and the cycle will repeat.

As long as the cycle time of the onward/offward cutter loading is shorter than the time required for the lubricant to bleed from the thrust face area (at the applied load) the thrust faces will not contact.

It is therefore the object of this invention to provide a sealed and lubricated rolling cutter drill bit with an improved lubricant system which provides selectively pressurized hydrostatic thrust bearing lubrication by allowing lubricant to flow into the thrust bearing area easily and restricting the flow of the lubricant out of the area without pressurizing the bearing seal.

SUMMARY OF THE INVENTION

The invention therefore provides a rolling cutter drill bit comprising a body and a plurality of legs, at least one of said legs having a cantilevered bearing spindle, a rolling cutter rotatably mounted on the bearing spindle, bearing means located between the cutter and the spindle and including a thrust bearing configured to carry onward thrust loads from the cutter onto the spindle, bearing seal means defining an enclosed region between the cutter and the spindle in which said bearing means are located, and lubricant delivery means within the spindle to deliver lubricant to the bearing means, said lubricant delivery means including flow control means to allow lubricant to flow into an area of said enclosed region containing the thrust bearing and to restrict the flow of lubricant out of said thrust bearing area and into another area of said enclosed region.

Said flow control means may include an inlet flowpath leading to said thrust bearing area and valve means controlling the flow of lubricant along said inlet flowpath.

In one embodiment of the invention said valve means comprise a non-return valve arranged to permit flow of lubricant along said inlet flowpath and into said thrust bearing area and substantially to prevent flow of lubricant back along said flowpath away from the thrust bearing area, there being provided a restricted outlet flowpath, leading away from said thrust bearing area, which is separate from said inlet flowpath.

The restricted outlet flowpath may include at least one narrow annular gap between an outer surface on the bearing spindle and an inner surface on the rolling cutter. Said outer and inner surfaces may be substantially cylindrical.

One of said inner and outer surfaces may be provided by a separately formed annular bushing mounted on one of said bearing spindle and said rolling cutter. Preferably the annular bushing is mounted on the bearing spindle and provides the aforesaid outer surface thereon.

The thrust bearing may be annular, having an inner and an outer periphery, and said inlet flowpath then preferably leads to an inlet located within the inner periphery of the thrust bearing, said restricted outlet flowpath being located outside the outer periphery of the thrust bearing.

The aforesaid bearing means may further include a radial bearing located within the bearing region and configured to carry radial loads from the cutter onto the spindle, said restricted outlet flowpath being located, at least in part, between said thrust bearing area and an area of the bearing region containing said radial bearing.

In any of the above arrangements the restricted outlet flowpath may include a tortuous path provided by a flexibly resilient sealing ring between the bearing spindle and the rolling cutter. The sealing ring is preferably located on the opposite side of said radial bearing to said thrust bearing.

In an alternative embodiment of the invention the aforesaid valve means are arranged to permit flow of lubricant along said inlet flowpath and into said thrust bearing area, and also to permit a more restricted flow of lubricant in the opposite direction along said inlet flowpath and away from said thrust bearing area. In this case the valve means may comprise a flexible barrier element extending at least partly across said inlet flowpath, said barrier element having a free edge located adjacent an abutment surface and on the side of the abutment surface nearer said thrust bearing area, whereby flow of lubricant away from the thrust bearing area deflects the barrier element towards said abutment surface to restrict the flow of lubricant between the barrier element and the abutment.

The inlet flowpath may include at least one annular gap between an outer surface on the bearing spindle and an inner surface on the rolling cutter, said barrier element comprising an annular bearing ring projecting across said gap from one of said components to lie adjacent a peripheral annular abutment on the other of said components.

The barrier ring is preferably mounted on the rolling cutter and the peripheral annular abutment is on the bearing spindle. In the case where a retaining ring is mounted on the inner surface of the rolling cutter and is received within an annular groove in the outer surface of the bearing spindle, an outer peripheral portion of said barrier ring may be clamped between the retaining ring and an annular surface on the rolling cutter.

In any of the above arrangements a pressure balancing diaphragm is preferably provided in communication with said enclosed region between the cutter and spindle in which said bearing means are located.

DETAILED DESCRIPTION OF THE PREFERRED EMBODIMENTS

Figure 1:
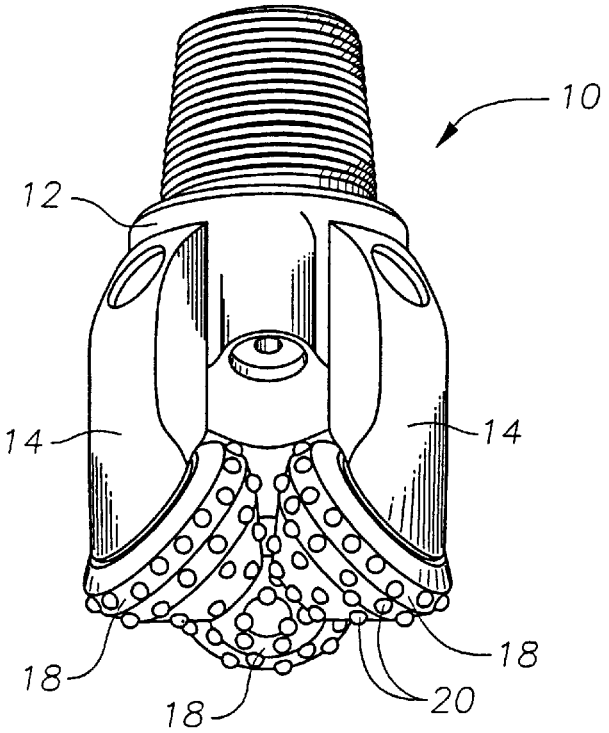
FIG. 1 is a perspective view of a rolling cutter bit of the present invention.
Figure 2:
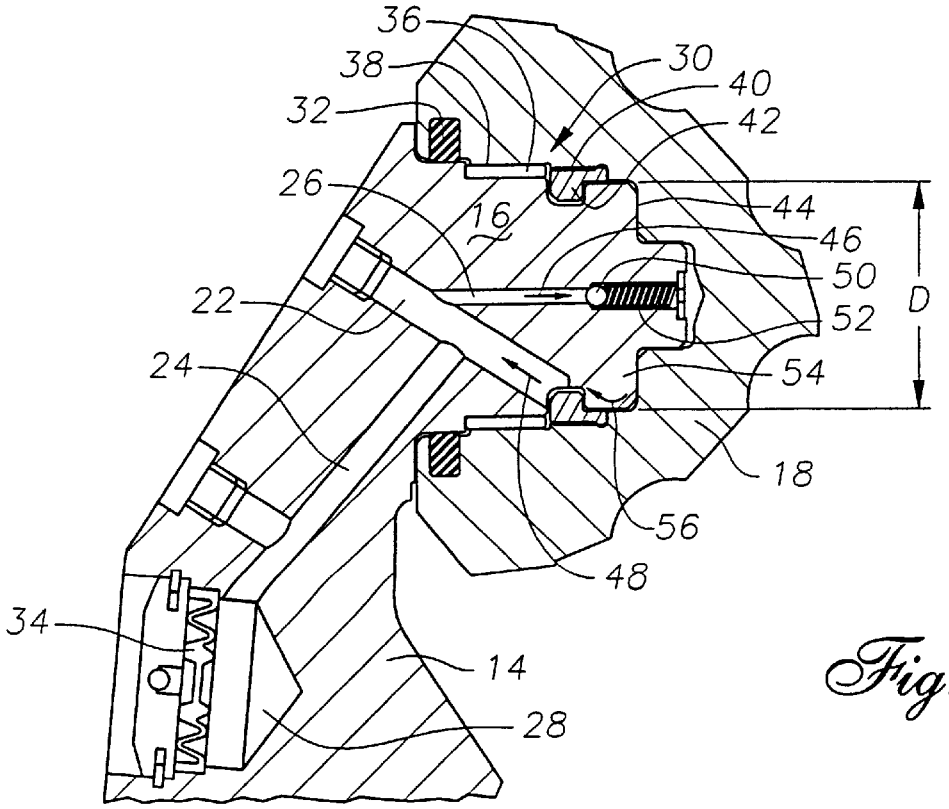
FIG. 2 is a cross sectional view of the preferred embodiment of an earth boring bit of the present invention showing the general arrangement of the lubrication and bearing systems.

Referring now to the drawings in more detail, and particularly to FIGS. 1 and 2, an earth boring bit 10 is a rolling cutter drill bit and includes a body 12 (portions of which are not shown). The body 12 of a typical rolling cutter drill bit comprises three similar leg portions 14 (only two of which are seen in FIG. 1). A cantilevered bearing spindle 16 formed on each leg 14 extends inwardly and downwardly. A rolling cutter 18 is rotatably mounted upon the spindle 16 as hereinafter explained. Attached to the rolling cutter 18 are cutting inserts 20 which engage the earth to effect a drilling action and cause rotation of the rolling cutter 18. Typically, each cutting insert 20 will be formed of a hard, wear resistant material. Internal passageways 22, 24, and 26, as well as a reservoir 28 and bearing area 30 of the leg 14, are filled with lubricant (not shown) during bit assembly. The lubricant helps reduce bearing friction and wear during bit operation and is retained within the cutter 18 by a dynamic seal 32. Average pressure differentials between the lubricant and the external environment of the bit are equalized by the movement of a pressure balancing diaphragm 34.

The cutter 18 is rotatably mounted upon the cantilevered bearing spindle 16 formed on the leg 14. A sliding bearing member 36 is mounted between the spindle 16 and a mating bearing cavity 38 formed in the cutter 18. This bearing 36 is designed to carry the radial loads imposed upon the cutter 18 during drilling. A second bearing member 42 is configured as a split threaded ring which engages internal threads 40 in the cutter 18. This second bearing member 42 serves to retain the cutter 18 upon the bearing spindle by resisting the forces which tend to push the cutter 18 off the bearing spindle 16 during drilling.

Figure 3:
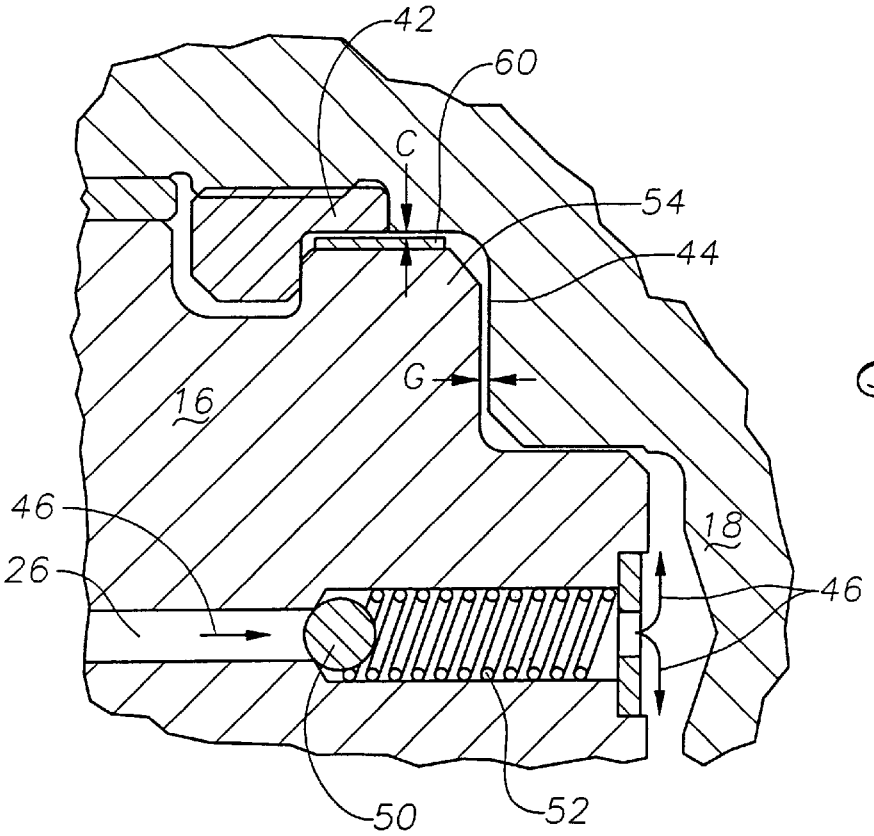
FIG. 3 is an enlarged view of the preferred embodiment.
Figure 4:
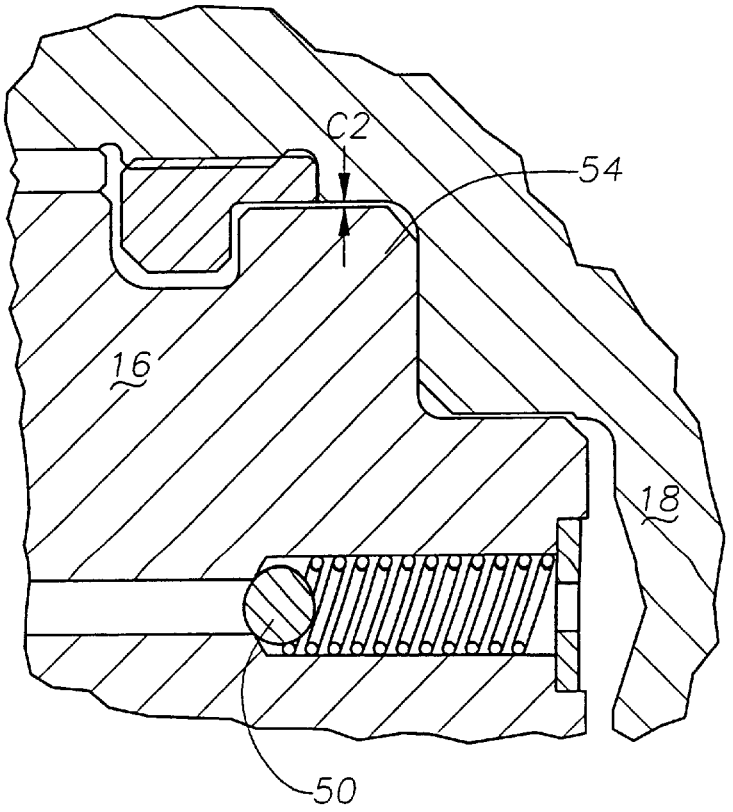
FIG. 4 is an enlarged cross section view of a second embodiment of the present invention.

A thrust bearing 44 carries the onward thrust forces imposed upon the cutter 18 during drilling. This thrust bearing 44 must stand the impact loading present in rock bits during severe service at all running speeds and temperatures. In the present invention, the asperity contact of the thrust bearing face is minimized by selectively pressurizing the lubricant contained within the area of the thrust face defined by diameter D. As the cutter 18 moves on and off the bearing spindle 16 during operation, the piston action forces lubricant to flow into and out of the bearing area 30 to the reservoir 28. As shown in FIG. 3, when the cutter 18 moves off the bearing spindle 16 during operation, a gap G opens at the thrust area 44. Lubricant fills the thrust area 44 by flowing through the passage 26 as indicated by the arrow 46, flows around a check valve ball 50, and fills the gap G being formed in the thrust area 44. Referring again to FIG. 2, when the cutter 18 is pushed back on to the bearing spindle 16 with an onward load during drilling, the lubricant cannot flow past the check valve ball 50. Instead, the lubricant must follow a more tortuous path around the threaded ring flange 54 as indicated by arrow 56. This causes a differential pressure between the thrust face 44 and bearing area 30. The pressure of the lubricant at the thrust face 44 is related to the area of the thrust face defined by diameter D, and the onward load applied to the cutter 18. The flow rate of the lubricant away from the thrust area 44 is determined by that pressure, the lubricant's viscosity and the effective orifice area of the tortuous passage 56 around the threaded ring flange 54.

Figure 7A:
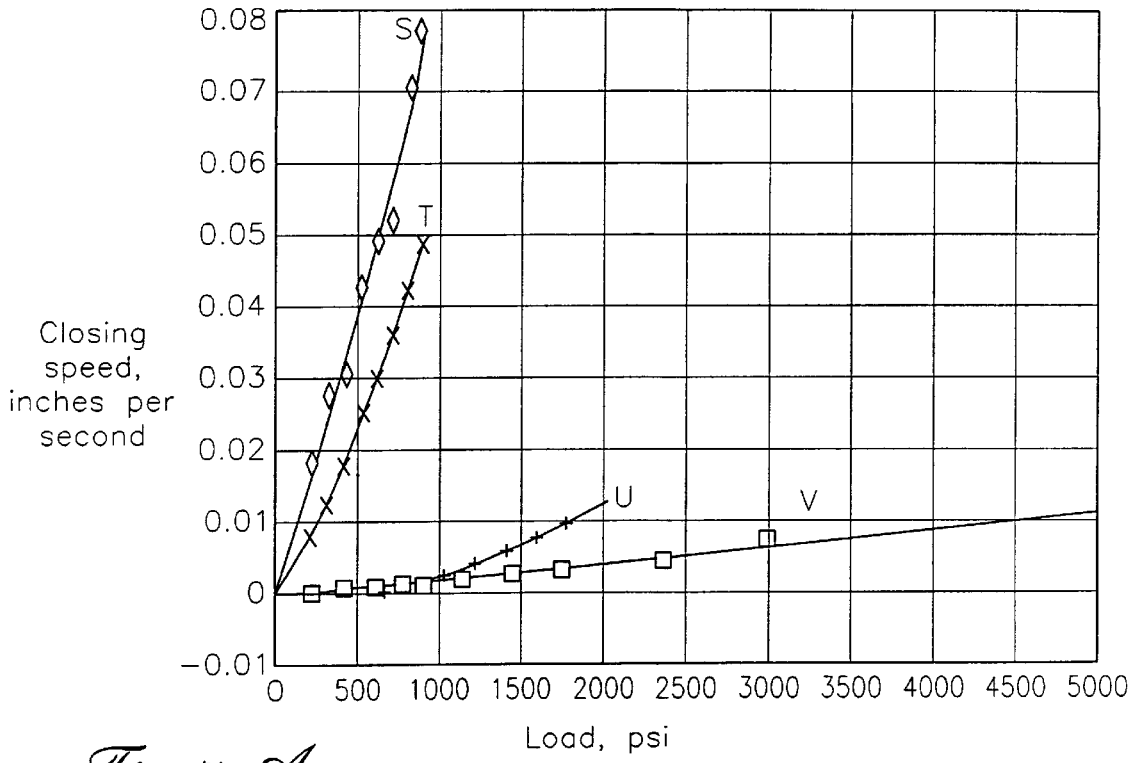
FIG. 7 graphically displays the results of lab tests demonstrating the dynamic pressure vs displacement characteristics of standard bits and bits made in accordance with the present invention.
Figure 7B:
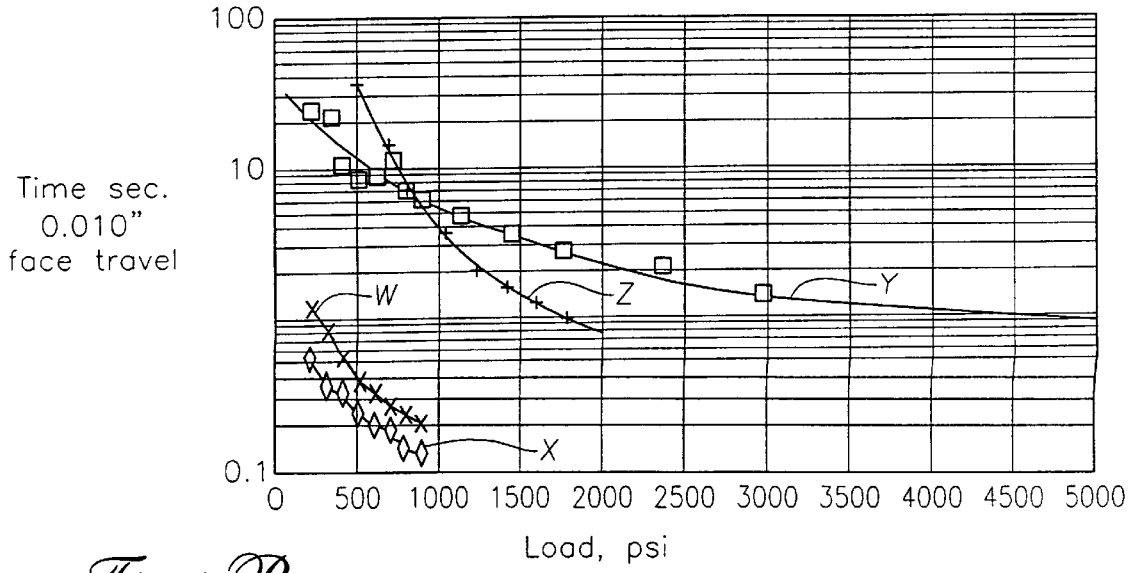

Shown in FIG. 7 are results of lab testing comparing the time required for the cutter 18 to move onto the bearing spindle 16 a distance of 0.010" for both standard bits and bits of the present invention. Curves S, T, W and X represent tests performed with standard bits. Curves U, V, Y and Z are tests of bits made in accordance with the present invention. As shown in curve Y of FIG. 7, lubricant pressures greater than 5000 psi can be maintained for nearly one second throughout the thrust area as the clearance gap closes by 0.010" for bits made in accordance with this invention.

During the time the lubricant is flowing from the thrust area 44, the entire axial load applied to the cutter is carried by the lubricant. As the lubricant returns to the reservoir by flowing through passage 22 (as indicated by arrow 48), the gap G at the thrust face 44 closes. Although normal drilling operations typically provide adequate load cycling to prevent contact of the thrust faces, if face contact does occur, the thrust bearing operation of the present invention will temporarily revert to the typical operating mode of the thrust bearings of the prior art.

Several means of providing one way flow and lubricant return restrictions are shown in FIGS. 3–6. FIG. 3 shows a barrier bushing 60 mounted upon the threaded ring flange 54. The barrier bushing provides a substantial reduction in the radial clearance, to an amount C, of a standard rock bit without modification of standard parts. Providing this small clearance C resulted in a substantial increase in "dwell" time at pressure. As shown in FIG. 7, the curves V and Y of the present invention show a substantially longer dwell time and consequently slower closing speeds than comparable curves for a standard bit, S and X. A similar clearance C2 is shown without a barrier bushing in FIG. 4 by re-designing the threaded ring flange 54 to have a larger diameter.

Figure 5:
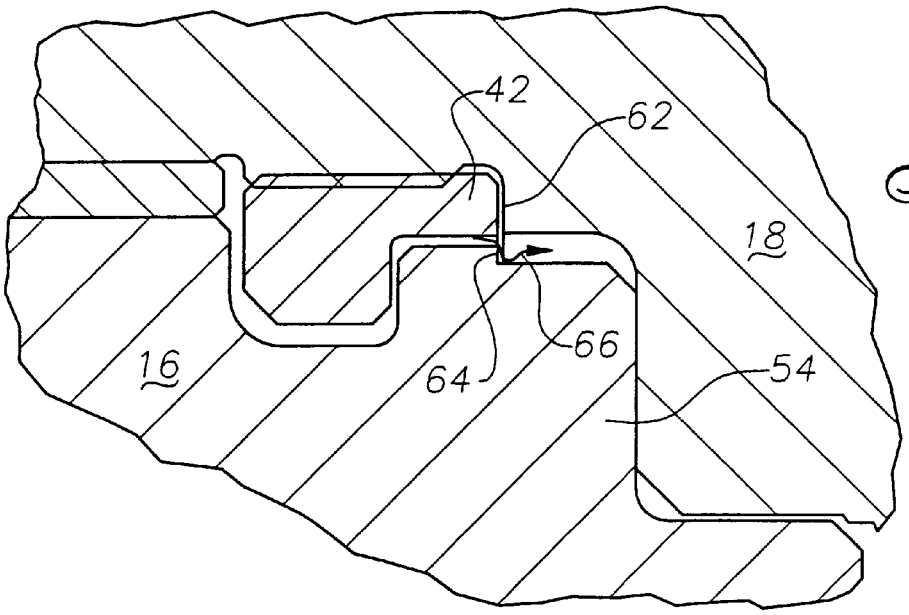
FIG. 5 is an enlarged cross section view of a third embodiment of the present invention.

An alternative means of restricting the lubricant flow out of the thrust face area is shown in FIG. 5. A barrier ring 62 is captured between the threaded ring 42 and the cutter 18. The barrier ring 62 contacts the bearing spindle 16 at flange 64. The barrier ring 62 is flexible and pressure occurring at the thrust face pushes the barrier ring 62 against the flange 64, effecting a tortuous lubricant return path. The effectiveness of this design is shown as curves U and Z in FIG. 7. The barrier ring 62 in this design behaves as a check valve and can serve as a substitute for the check ball 50 and related components shown in the other embodiments. In this case, the lubricant flow into the thrust area 44 is around the barrier ring 62 as shown by flow arrow 66.

Figure 6:
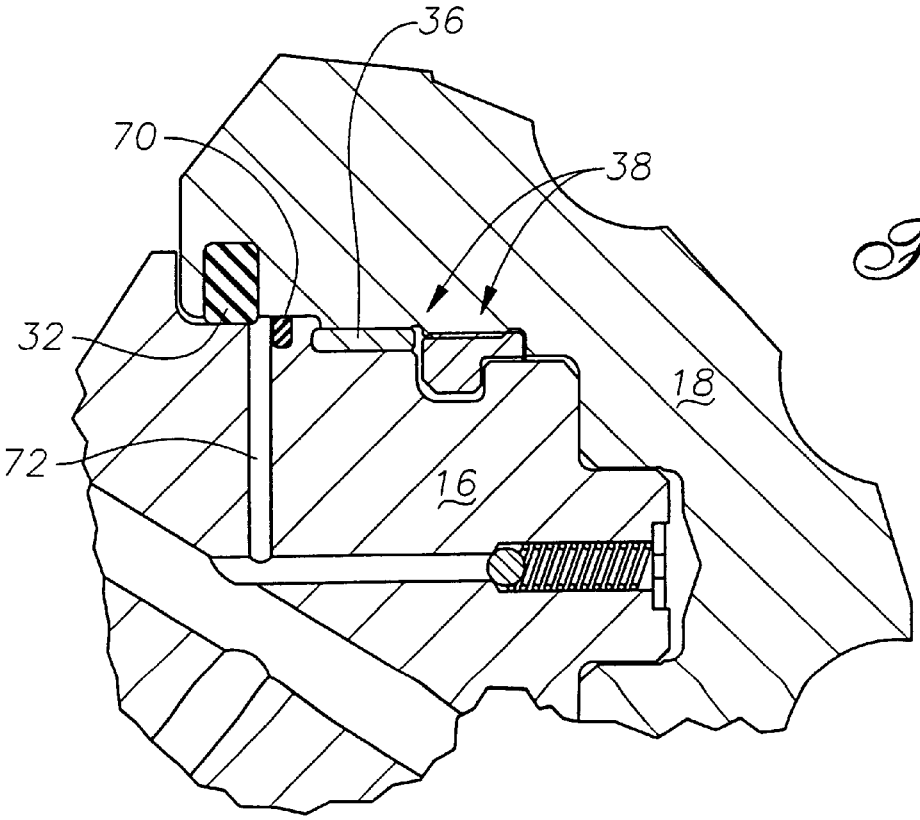
FIG. 6 is an enlarged cross section view of a fourth embodiment of the present invention.

Still another embodiment of the invention is shown in FIG. 6. In this design, a ring seal 70, aching in a manner similar to a piston ring, is installed between the dynamic seal 32 and the sliding bearing member 36. A passageway 72 allows the pressure near the dynamic seal 32 to be balanced by the pressure balancing diaphragm 34. The tortuous path to lubricant flow provided by the ring seal 70 allows lubricant in the entire bearing cavity 38 to increase in response to onward loading as described earlier. It also prevents the potentially high pressure so generated from damaging the dynamic seal 32

Whereas the present invention has been described in particular relation to the drawings attached hereto, it should be understood that other and further modifications, apart from those shown or suggested herein, may be made within the scope and spirit of the present invention

What is claimed:

1. A rolling cutter drill bit comprising a body and a plurality of legs, at least one of said legs having a cantilevered bearing spindle, a rolling cutter rotatably mounted on the bearing spindle, bearing means located between the cutter and the spindle and including a thrust bearing configured to carry onward thrust loads from the cutter onto the spindle, bearing seal means defining an enclosed region between the cutter and the spindle in which said bearing means are located, and lubricant delivery means within the spindle to deliver lubricant to the bearing means, said lubricant delivery means including flow control means to allow lubricant to flow into an area of said enclosed region containing the thrust bearing and to restrict the flow of lubricant out of said thrust bearing area and into another area of said enclosed region, said flow control means including an inlet flowpath leading to said thrust bearing area and valve means controlling the flow of lubricant along said inlet flowpath, said valve means being arranged to permit flow of lubricant along said inlet flowpath and into said thrust bearing area, and also to permit a more restricted flow of lubricant in the opposite direction along said inlet flowpath and away from said thrust bearing area.

2. A drill bit according to claim 1, wherein said valve means comprise a flexible barrier element extending at least partly across said inlet flowpath, said barrier element having a free edge located adjacent an abutment surface and on the side of the abutment surface nearer said thrust bearing area, whereby flow of lubricant away from the thrust bearing area deflects the barrier element towards said abutment surface to restrict the flow of lubricant between the barrier element and the abutment.

3. A drill bit according to claim 2, wherein said inlet flowpath includes at least one annular gap between an outer surface on the bearing spindle and an inner surface on the rolling cutter, and said barrier element comprises an annular bearing ring projecting across said gap from one of said components to lie adjacent a peripheral annular abutment on the other of said components.

4. A drill bit according to claim 3, wherein the barrier ring is mounted on the rolling cutter and the peripheral annular abutment is on the bearing spindle.

5. A drill bit according to claim 4, wherein a retaining ring mounted on the inner surface of the rolling cutter is received within an annular groove in the outer surface of the bearing spindle, and an outer peripheral portion of said barrier ring is clamped between the retaining ring and an annular surface on the rolling cutter.

6. A drill bit according to claim 1, wherein said bearing means further include a radial bearing located within said enclosed region and configured to carry radial loads from the cutter onto the spindle, said restricted outlet flowpath being located, at least in part, between said thrust bearing area and an area of the enclosed region containing said radial bearing.

7. A drill bit according to claim 1, wherein a pressure balancing diaphragm is in communication with said enclosed region between the cutter and spindle in which said bearing means are located.

* * * * *